US008054245B2

(12) United States Patent
Kim et al.

(10) Patent No.: US 8,054,245 B2
(45) Date of Patent: Nov. 8, 2011

(54) PLASMA DISPLAY APPARATUS AND METHOD OF DRIVING PLASMA DISPLAY APPARATUS

(75) Inventors: Won Jae Kim, Gyeonsangnam-do (KR); Sung Im Lee, Gyeongsangbuk do (KR)

(73) Assignee: LG Electronics Inc., Seoul (KR)

( * ) Notice: Subject to any disclaimer, the term of this patent is extended or adjusted under 35 U.S.C. 154(b) by 1141 days.

(21) Appl. No.: 11/450,416

(22) Filed: Jun. 12, 2006

(65) Prior Publication Data

US 2006/0279486 A1 Dec. 14, 2006

(30) Foreign Application Priority Data

Jun. 13, 2005 (KR) ..... 10-2005-0050644

(51) Int. Cl.
*G09G 3/10* (2006.01)
*G09G 3/28* (2006.01)

(52) U.S. Cl. ..... 345/41; 345/37; 345/60; 315/169.4

(58) Field of Classification Search ..... 345/37, 345/41, 42, 60–72; 315/169.4
See application file for complete search history.

(56) References Cited

U.S. PATENT DOCUMENTS

| | | | |
|---|---|---|---|
| 2003/0001804 | A1 | 1/2003 | Naganuma |
| 2005/0200569 | A1 | 9/2005 | Kim et al. |

FOREIGN PATENT DOCUMENTS

| | | | |
|---|---|---|---|
| CN | 1495691 | | 5/2004 |
| EP | 1 274 064 | A2 | 1/2003 |
| EP | 1 398 756 | A2 | 3/2004 |
| EP | 1 732 056 | A1 | 12/2006 |
| KR | 10-2006-0053537 | A | 5/2006 |

*Primary Examiner* — Srilakshmi K Kumar
(74) *Attorney, Agent, or Firm* — Birch, Stewart, Kolasch & Birch, LLP

(57) ABSTRACT

A plasma display apparatus and a method of driving the plasma display apparatus are provided. A maintenance period of a sustain signal changes depending on a temperature of a plasma display panel or an ambient temperature of the plasma display panel.

18 Claims, 8 Drawing Sheets

PLASMA DISPLAY APPARATUS AND METHOD OF DRIVING PLASMA DISPLAY APPARATUS

This Nonprovisional application claims priority under 35 U.S.C. §119(a) on Patent Application No. 10-2005-0050644 filed in Korea on Jun. 13, 2005 the entire contents of which are hereby incorporated by reference.

BACKGROUND OF THE INVENTION

1. Field of the Invention

This document relates to a plasma display apparatus and a method of driving the plasma display apparatus.

2. Description of the Background Art

A plasma display apparatus displays an image on a plasma display panel. Each of cells of the plasma display panel is filled with an inert gas containing a main discharge gas such as neon (Ne), helium (He) or a Ne—He gas mixture and a small amount of xenon (Xe). When a high frequency voltage is supplied to an electrode of the plasma display panel, the inert gas within the cells emits vacuum ultraviolet rays. The image is displayed on the plasma display panel by the light-emission of a phosphor formed between barrier ribs.

The plasma display apparatus represent gray scale by a combination of subfields, where the number of light-emissions of each of the subfields is different from one another. Each of the subfields comprises a reset period for initializing the cells of the plasma display panel, an address period for selecting the cells, and a sustain period for representing gray scale in accordance with the number of light-emissions.

The plasma display apparatus for representing gray scale by the combination of the subfields displays an image using a discharge generated by a driving signal supplied to the electrode. In other words, the plasma display apparatus displays an image using a driving signal supplied during each of the reset period, the address period and the sustain period In the reset period, when a reset signal is supplied to a scan electrode of the plasma display apparatus, wall charges of the cells of the plasma display apparatus remain uniformly.

In the address period, when a scan signal is supplied to the scan electrode and a data signal synchronized with the scan signal is supplied to an address electrode of the plasma display apparatus, the cells, in which a sustain discharge will be generated, are selected.

In the sustain period, when a sustain signal is alternately supplied to the scan electrode and a sustain electrode of the plasma display apparatus, the sustain discharge is generated in the cells selected in the address period. The plasma display apparatus displays an image by performing the sustain discharge.

SUMMARY OF THE INVENTION

According to one aspect, there is a provided a plasma display apparatus comprising a plasma display panel comprising an electrode, and a sustain signal supply unit for supplying a first sustain signal to the electrode when a temperature of the plasma display panel or an ambient temperature of the plasma display panel is equal to or more than a reference temperature, and for supplying a second sustain signal to the electrode when the temperature of the plasma display panel or the ambient temperature of the plasma display panel is less than the reference temperature, wherein the first sustain signal and the second sustain signal are different from each other.

According to another aspect, there is a provided a plasma display apparatus comprising a plasma display panel comprising an electrode, and a sustain signal supply unit for supplying a sustain signal to the electrode. Wherein an application period of the sustain signal comprises a rising period for rising from a first voltage to a second voltage, a maintenance period for maintaining the second voltage, and a falling period for falling from the second voltage to a third voltage, and wherein the durations of the maintenance periods of the sustain signals supplied at two or more different temperature intervals comprising a temperature of the plasma display panel or an ambient temperature of the plasma display panel are different from one another.

According to still another aspect, there is provided a method of driving a plasma display apparatus comprising an electrode comprising supplying a first sustain signal having a maintenance period to the electrode when a temperature of a plasma display panel or an ambient temperature of the plasma display panel, is equal to or more than a reference temperature, and supplying a second sustain signal having a maintenance period to the electrode when the temperature of the plasma display panel or the ambient temperature of the plasma display panel, is less than the reference temperature, wherein the duration of the maintenance period of the first sustain signal is different from the duration of the maintenance period of the second sustain signal.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
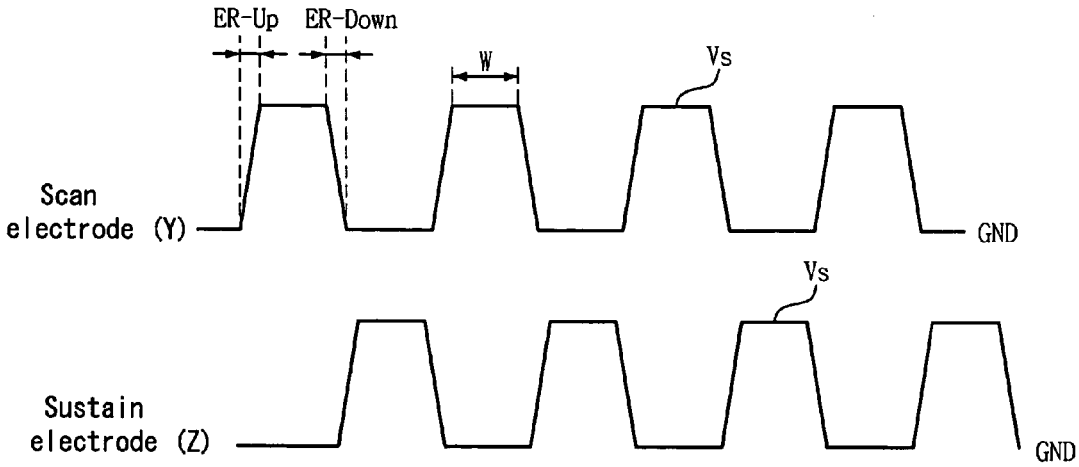
FIG. 1 illustrates a sustain signal supplied in a sustain period.

Embodiments of the present invention will be described in a more detailed manner with reference to the drawings.

A plasma display apparatus according to embodiments of the present invention comprises a plasma display panel comprising an electrode, and a sustain signal supply unit for supplying a first sustain signal to the electrode when a temperature of the plasma display panel or an ambient temperature of the plasma display panel is equal to or more than a reference temperature, and for supplying a second sustain signal to the electrode when the temperature of the plasma display panel or the ambient temperature of the plasma display panel is less than the reference temperature. The first sustain signal and the second sustain signal are different from each other.

The application period of each of the first sustain signal and the second sustain signal may comprise a rising period for rising from a first voltage to a second voltage, a maintenance period for maintaining the second voltage, and a falling period for falling from the second voltage to a third voltage. The duration of the maintenance period of the first sustain signal may be different from the duration of the maintenance period of the second sustain signal.

The duration of the maintenance period of the first sustain signal may be longer than the duration of the maintenance period of the second sustain signal.

The duration of the rising period of the first sustain signal may be different from the duration of the rising period of the second sustain signal.

The duration of the rising period of the first sustain signal may be shorter than the duration of the rising period of the second sustain signal.

The duration of the falling period of the first sustain signal may be different from the duration of the falling period of the second sustain signal.

The duration of the falling period of the first sustain signal may be shorter than the duration of the falling period of the second sustain signal.

The reference temperature may be one of a plurality of reference temperatures. When the reference temperature is the lowest reference temperature in the plurality of reference temperatures, the duration of the maintenance period of the second sustain signal may be shortest.

The duration of the maintenance period of the first sustain signal may be one time to five times the rising period of the first sustain signal or the rising period of the second sustain signal longer than the duration of the maintenance period of the second sustain signal.

A plasma display apparatus according to the embodiment of the present invention comprises a plasma display panel comprising an electrode, and a sustain signal supply unit for supplying a sustain signal to the electrode. An application period of the sustain signal comprises a rising period for rising from a first voltage to a second voltage, a maintenance period for maintaining the second voltage, and a falling period for falling from the second voltage to a third voltage. The durations of the maintenance periods of the sustain signals supplied at two or more different temperature intervals comprising a temperature of the plasma display panel or an ambient temperature of the plasma display panel are different from one another.

When the temperature of the plasma display panel or the ambient temperature of the plasma display panel is a first temperature, a second temperature or a third temperature, the durations of the maintenance periods of the sustain signals supplied at each of the first, second and third temperatures may be different from one another.

When the temperature of the plasma display panel or the ambient temperature of the plasma display panel is the first temperature or the second temperature, the sustain signal supply unit may supply a first sustain signal or a second sustain signal. The duration of the maintenance period of the first sustain signal may be different from the duration of the maintenance period of the second sustain signal.

When the first temperature is higher than the second temperature, the duration of the maintenance period of the first sustain signal may be longer than the duration of the maintenance period of the second sustain signal.

The duration of the rising period of the first sustain signal may be substantially equal to the duration of the rising period of the second sustain signal.

The duration of the falling period of the first sustain signal may be substantially equal to the duration of the falling period of the second sustain signal.

The number of temperature intervals may equal to five.

A method of driving a plasma display apparatus comprising an electrode according to the embodiments of the present invention comprises supplying a first sustain signal having a maintenance period to the electrode when a temperature of a plasma display panel or an ambient temperature of the plasma display panel, is equal to or more than a reference temperature, and supplying a second sustain signal having a maintenance period to the electrode when the temperature of the plasma display panel or the ambient temperature of the plasma display panel, is less than the reference temperature. The duration of the maintenance period of the first sustain signal is different from the duration of the maintenance period of the second sustain signal.

The duration of the maintenance period of the first sustain signal may be longer than the duration of the maintenance period of the second sustain signal.

Hereinafter, exemplary embodiments of the present invention will be described in detail with reference to the attached drawings.

FIG. 1 illustrates a sustain signal supplied in a sustain period. As shown in FIG. 1, an application period of a sustain signal comprises a rising period ER-Up in which a voltage of the sustain signal rises from a ground level voltage GND to a sustain voltage Vs, a maintenance period W in which the voltage of the sustain signal is maintained at the sustain voltage Vs, and a falling period ER-down in which the voltage of the sustain signal falls from the sustain voltage Vs to the ground level voltage GND. The above sustain signal is supplied to a scan electrode Y and a sustain electrode Z of a plasma display apparatus.

In an embodiment of the present invention, the duration of the maintenance period W of the sustain signal changes depending on a temperature of a plasma display panel included in the plasma display apparatus or an ambient temperature of the plasma display panel. The change in the duration of the maintenance period W of the sustain signal depending on the temperature will be described in detail later. Hereinafter, the temperature of the plasma display panel or the ambient temperature of the plasma display panel is referred to as a comparative temperature.

Figure 2:
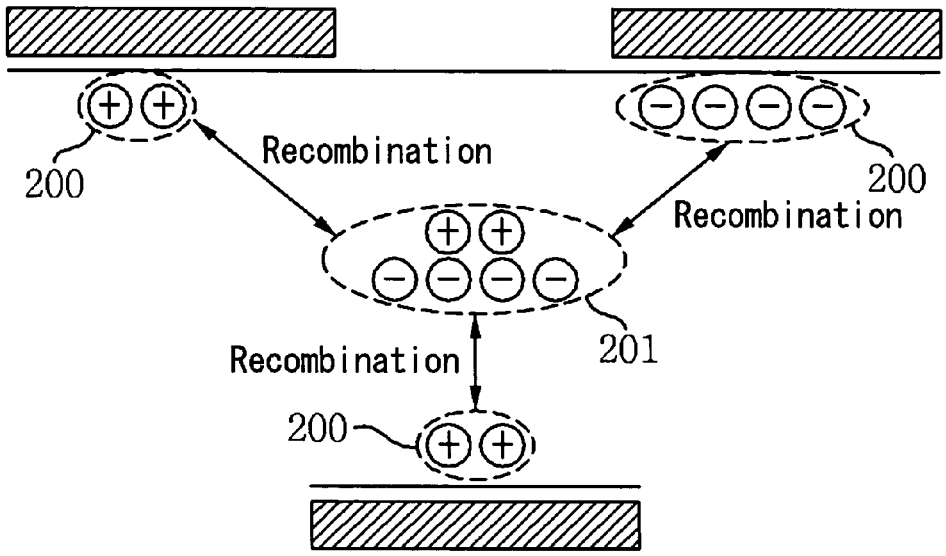
FIG. 2 illustrates a change in distribution of wall charges depending on a temperature of a plasma display panel or an ambient temperature of the plasma display panel.

FIG. 2 illustrates a change in distribution of wall charges depending on a temperature of a plasma display panel or an ambient temperature of the plasma display panel. When a temperature of the plasma display panel or an ambient temperature of the plasma display panel increases, a percentage of recombination of space charges 201 and wall charges 200 within a cell increases. As a result, an amount of the wall charges 200 for generating a discharge decreases. Thus, when the temperature of the plasma display panel or the ambient temperature of the plasma display panel is high, an erroneous discharge is generated.

In other words, when the comparative temperature is high, a percentage of the recombination of the space charges 201 and the wall charges 200 increases in an address period. Thus, an amount of the wall charges 200 for generating an address discharge decreases such that the unstable address discharge is generated. The address discharge is later performed on the cell located on the scan electrode to which a scan signal is later supplied. Thus, time capable of recombining the space charges 201 and the wall charges 200 becomes longer and the address discharge is generated more unstably. Further, when supplying the sustain signal, the quantity of light generated in the cell is unusually little by the unstable address discharge.

Further, when the temperature of the plasma display panel or the ambient temperature of the plasma display panel is low, a percentage of the recombination of the space charges 201 and the wall charges 200 decreases. As a result, an amount of the wall charges 200 within the discharge cell is excessively much. Thus, when the comparative temperature is low, the quantity of light generated by the sustain signal is excessively much.

Figure 3:
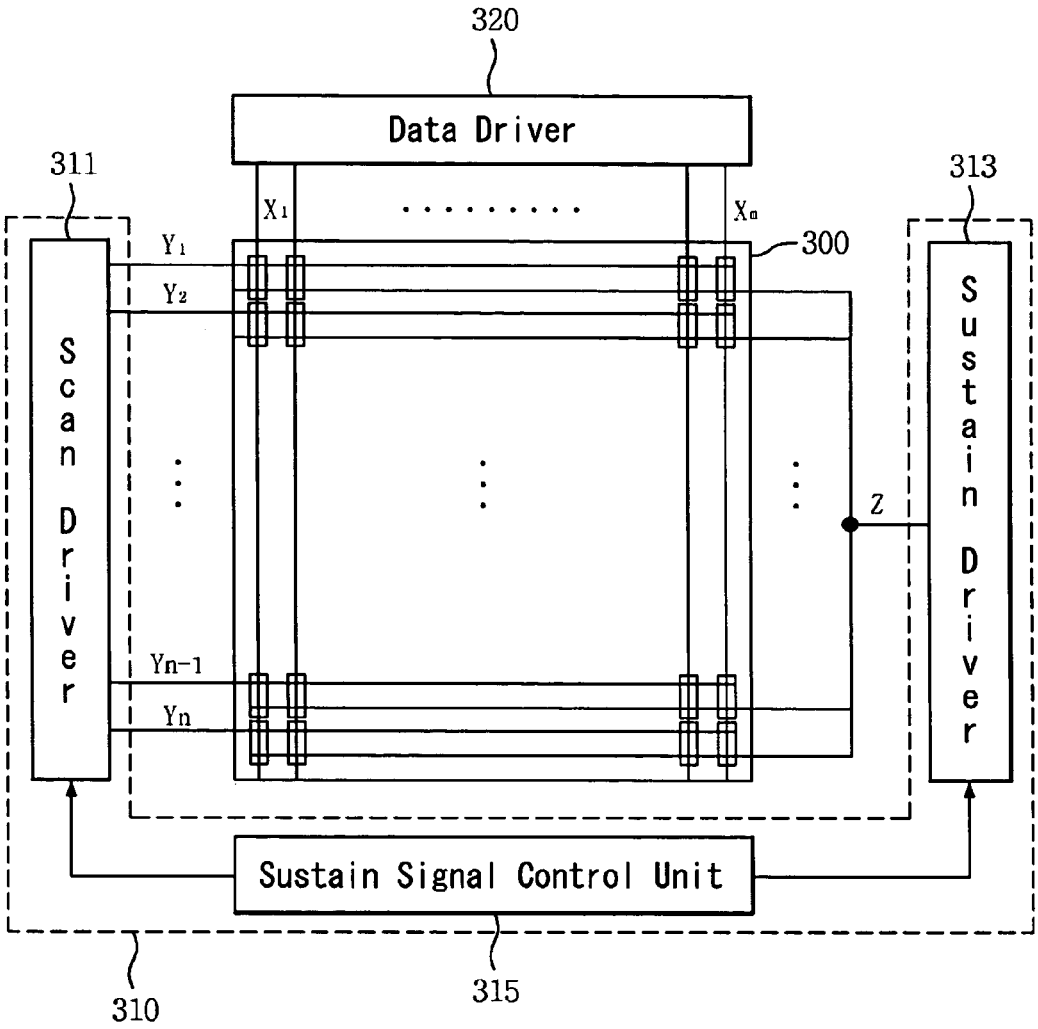
FIG. 3 illustrates a plasma display apparatus according to an embodiment of the present invention.

FIG. 3 illustrates a plasma display apparatus according to an embodiment of the present invention. As shown in FIG. 3, a plasma display apparatus according to the embodiment of the present invention comprises a plasma display panel 300, a sustain signal supply unit 310 and a data driver 320.

The plasma display panel 300 comprises address electrodes $X_1$ to $X_m$, scan electrodes $Y_1$ to $Y_n$, and sustain electrodes Z.

When a temperature of the plasma display panel 300 or an ambient temperature of the plasma display panel 300 is equal to or more than a reference temperature, the sustain signal supply unit 310 supplies a first sustain signal to at least one of the scan electrodes $Y_1$ to $Y_n$ and the sustain electrodes Z. When the temperature of the plasma display panel 300 or the ambient temperature of the plasma display panel 300 is less than the reference temperature, the sustain signal supply unit 310 supplies a second sustain signal different from the first sustain signal to at least one of the scan electrodes $Y_1$ to $Y_n$ and the sustain electrodes Z.

The sustain signal supply unit 310 comprises a scan driver 311, a sustain driver 313 and a sustain signal control unit 315. The scan driver 311 drives the scan electrodes $Y_1$ to $Y_n$ and the sustain driver 313 drives the sustain electrodes Z. The sustain signal control unit 315 controls the scan driver 311 and the sustain driver 313.

The scan driver 311 supplies a reset signal to the scan electrodes $Y_1$ to $Y_n$ in a reset period, and sequentially supplies a scan signal to the scan electrodes $Y_1$ to $Y_n$ in an address period. Further, the scan driver 311 supplies a sustain signal to the scan electrodes $Y_1$ to $Y_n$ in a sustain period under the control of the sustain signal control unit 315.

The sustain driver 313 supplies a bias voltage to the sustain electrodes Z in at least one of the reset period and the address period, and supplies a sustain signal to the sustain electrodes Z in the sustain period under the control of the sustain signal control unit 315.

The sustain signal control unit 315 controls the scan driver 311 and the sustain driver 313 in the sustain period to output a control signal for controlling the duration of a maintenance period of the sustain signal supplied to at least one of the scan electrodes $Y_1$ to $Y_n$ and the sustain electrodes Z depending on the temperature of the plasma display panel 300 or the ambient temperature of the plasma display panel 300. Thus, the scan driver 311 or the sustain driver 313 outputs the sustain signal which changes the duration of the maintenance period in accordance with the control signal.

The data driver 320 supplies a data signal to the address electrodes $X_1$ to $X_m$ of the plasma display panel 300.

Figure 4:
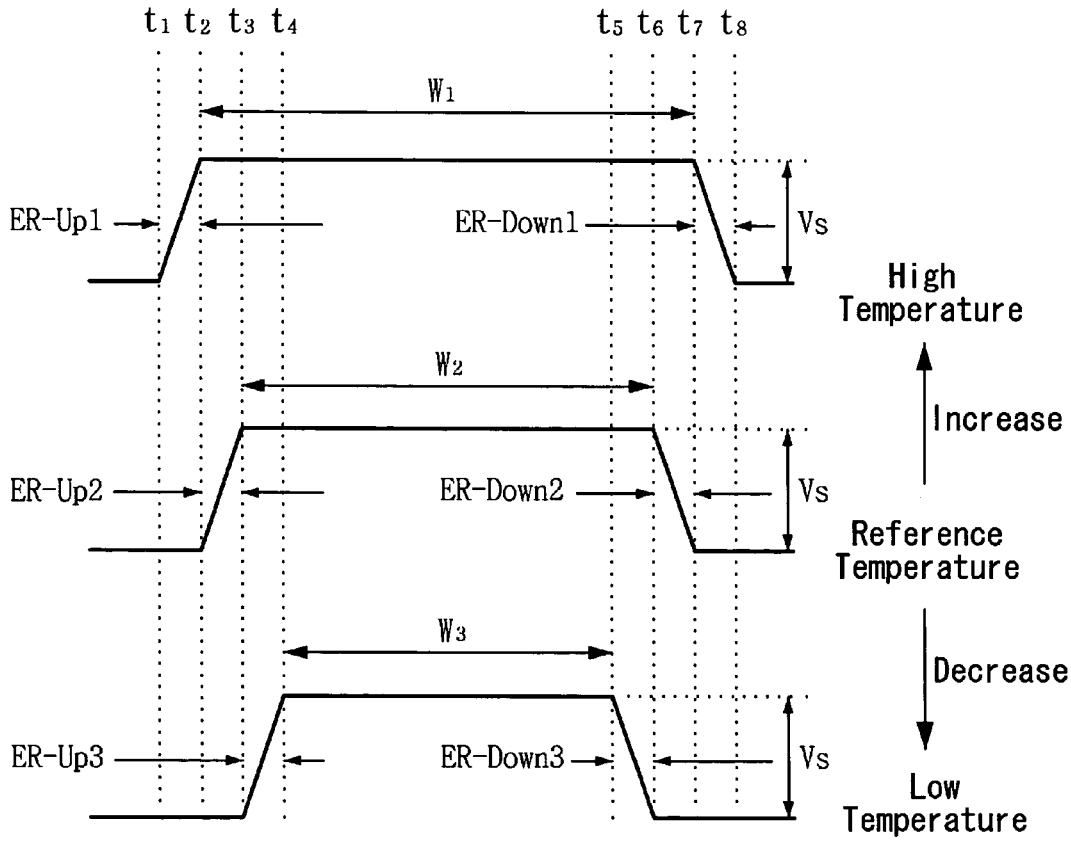
FIG. 4 illustrates a method of driving the plasma display apparatus according to the embodiment of the present invention.

FIG. 4 illustrates a method of driving the plasma display apparatus according to the embodiment of the present invention. As shown in FIG. 4, the duration of the maintenance period of the sustain signal supplied to at least one of the scan electrode and the sustain electrode during the sustain period is controlled depending on the comparative temperature. The maintenance period includes maintenance periods $W_1$, $W_2$ and $W_3$ in which the voltage of the sustain signal is maintained at the sustain voltage Vs.

The duration of a maintenance period of a sustain signal supplied to at least one of the scan electrode and the sustain electrode during the sustain period, when the comparative temperature is more than the reference temperature and is high, is longer than the duration of a maintenance period of a sustain signal supplied to at least one of the scan electrode and the sustain electrode during the sustain period when the comparative temperature is equal to the reference temperature.

The duration of a maintenance period of a sustain signal supplied to at least one of the scan electrode and the sustain electrode during the sustain period, when the comparative temperature is less than the reference temperature and is low, is shorter than the duration of the maintenance period of the sustain signal supplied to at least one of the scan electrode and the sustain electrode during the sustain period when the comparative temperature is equal to the reference temperature.

For example, as shown in FIG. 4, when the comparative temperature is equal to the reference temperature, the duration of time of the maintenance period $W_2$ of the sustain signal supplied to at least one of the scan electrode and the sustain electrode ranges from a time point $t_3$ where the voltage of the sustain signal reaches the sustain voltage Vs to a time point $t_6$. When the comparative temperature is more than the reference temperature and is high, the duration of time of the maintenance period $W_1$ of the sustain signal supplied to at least one of the scan electrode and the sustain electrode ranges from a time point $t_2$ where the voltage of the sustain signal reaches the sustain voltage Vs to a time point $t_7$. When the comparative temperature is less than the reference temperature and is low, the duration of time of the maintenance period $W_3$ of the sustain signal supplied to at least one of the scan electrode and the sustain electrode ranges from a time point $t_4$ where the voltage of the sustain signal reaches the sustain voltage Vs to a time point $t_5$.

The duration of time of the maintenance period of the sustain signal is proportionate to the temperature of the plasma display panel or the ambient temperature of the plasma display panel.

As shown in FIG. 4, in the embodiment of the present invention, the duration of a rising period ER-Up1 of the sustain signal at a high temperature, the duration of a rising period ER-Up2 of the sustain signal at the reference temperature, and the duration of a rising period ER-Up3 of the sustain signal at a low temperature are equal to one another. Further, the duration of a falling period ER-Down1 of the sustain signal at the high temperature, the duration of a falling period ER-Down2 of the sustain signal at the reference temperature, and the duration of a falling period ER-Down3 of the sustain signal at the low temperature is equal to one another.

In FIG. 4, the durations of the rising periods of the sustain signals at different temperatures are equal to one another. However, the durations of the rising periods of the sustain signals may be different from one another. For example, the duration of the rising period of the sustain signal supplied at the high temperature may be shorter than the duration of the rising period of the sustain signal supplied at the low temperature. In FIG. 4, the durations of the falling periods of the sustain signals at different temperatures are equal to one another. However, the durations of the falling periods of the sustain signals may be different from one another. For example, the duration of the falling period of the sustain signal supplied at the high temperature may be shorter than the duration of the falling period of the sustain signal supplied at the low temperature.

An amount of the wall charges excessively decreases by an increase in the percentage of recombination of the space charges and the wall charges at the high temperature. Thus, in the embodiment of the present invention, the durations of the rising period and the falling period of the sustain signal supplied at the high temperature are shorter than the durations of the rising period and the falling period of the sustain signal supplied at the low temperature so that the wall charges are produced stably.

In the driving method of the plasma display apparatus according to the embodiment of the present invention, the duration of the maintenance period of the sustain signal supplied at the high temperature is one time to five times the rising period of the sustain signal at the high temperature or the rising period of the sustain signal at the low temperature longer than the duration of the maintenance period of the sustain signal supplied at the low temperature.

Here, the sustain signal supplied at the high temperature is called a first sustain signal and the sustain signal supplied at the low temperature is called a second sustain signal. When the difference between the duration of the maintenance period of the first sustain signal and the duration of the maintenance period of the second sustain signal is less than the duration of the rising period of the first sustain signal or the duration of the rising period of the second sustain signal, the percentage of the recombination of the wall charges and the space charge is more than a percentage of an increase in an amount of the wall charges within the discharge cell. Thus, it is likely to generate an erroneous discharge by a decrease in an amount of the wall charges. When the difference between the duration of the maintenance period of the first sustain signal and the duration of the maintenance period of the second sustain signal is more than five times longer than the duration of the rising period of the first sustain signal or the duration of the rising period of the second sustain signal, the percentage of the recombination of the wall charges and the space charge is less than a percentage of an increase in an amount of the wall charges within the discharge cell. Thus, it is likely to generate an erroneous discharge by an excessive amount of the wall charges.

Figure 5:
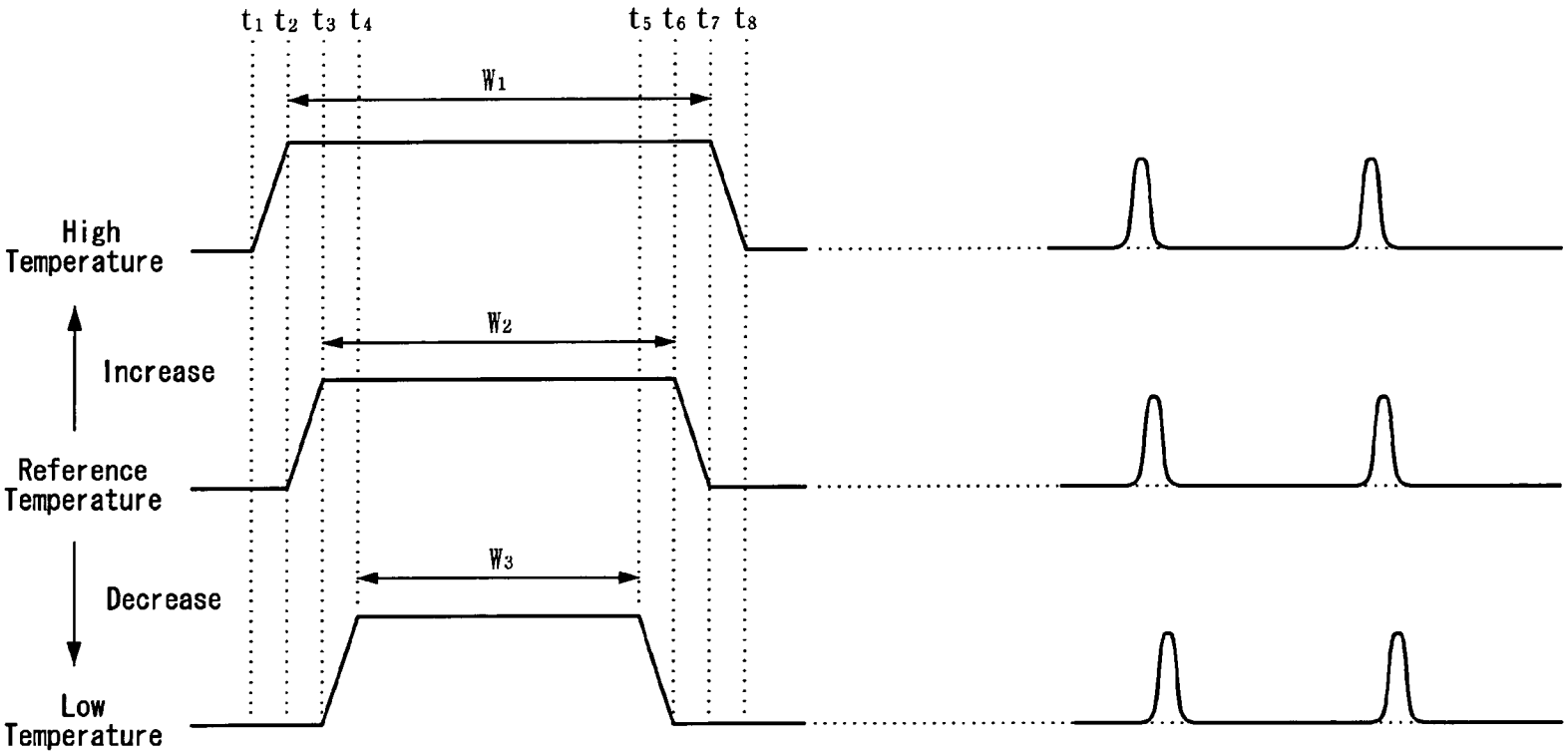
FIG. 5 illustrates a light characteristic by a driving signal of FIG. 4.

FIG. 5 illustrates a light characteristic by a driving signal of FIG. 4. As shown in FIG. 5, even when the comparative temperature changes, the quantity of light by the sustain signal supplied from the plasma display apparatus according to the embodiment of the present invention is fixed.

In the driving method of the plasma display apparatus according to the embodiment of the present invention, the duration of the maintenance period $W_1$ of the sustain signal at the high temperature, in which the comparative temperature is higher than the reference temperature, is more than the duration of the maintenance period $W_2$ of the sustain signal when the comparative temperature is equal to the reference temperature. Thus, an amount of the wall charges accumulated within the discharge cell by the sustain signal increases. When an amount of the wall charges increases at the high temperature, the quantity of light generated by the sustain signal increases. Even when the percentage of the recombination of the wall charges and the space charges within the cell increases at the high temperature, in which the comparative temperature is higher than the reference temperature, an amount of the wall charges within the cell increases by lengthening the duration of the maintenance period of the sustain signal. Thus, a decrease in the quantity of light is prevented.

Further, the duration of the maintenance period $W_3$ of the sustain signal at the low temperature, in which the comparative temperature is lower than the reference temperature, is less than the duration of the maintenance period $W_2$ of the sustain signal when the comparative temperature is equal to the reference temperature. Thus, an amount of the wall charges accumulated within the discharge cell by the sustain signal decreases. When an amount of the wall charges decreases at the low temperature, the quantity of light generated by the sustain signal decreases. Even when the percentage of the recombination of the wall charges and the space charges within the cell decreases at the low temperature, in which the comparative temperature is lower than the reference temperature, an amount of the wall charges within the cell decreases by shortening the duration of the maintenance period of the sustain signal. Thus, an increase in the quantity of light is prevented.

Since the duration of the maintenance period $W_3$ of the sustain signal at the low temperature, in which the comparative temperature is lower than the reference temperature, is less than the duration of the maintenance period $W_2$ of the sustain signal when the comparative temperature is equal to the reference temperature, a self erase discharge is prevented.

That is, when an excessive amount of the wall charges is accumulated by a decrease in an amount of the recombined charges at the low temperature, a voltage level of the sustain signal falls from the sustain voltage to a ground level voltage and then the self erase discharge is generated by an excessive amount of the wall charges. As a result, an amount of the wall charges decreases. Therefore, it is not likely to generate the sustain discharge when supplying the sustain signal. Accordingly, in the plasma display apparatus and the driving method of the plasma display apparatus according to the embodiment of the present invention, the self erase discharge is prevented by shortening the duration of the maintenance period of the sustain signal at the low temperature.

Figure 6:
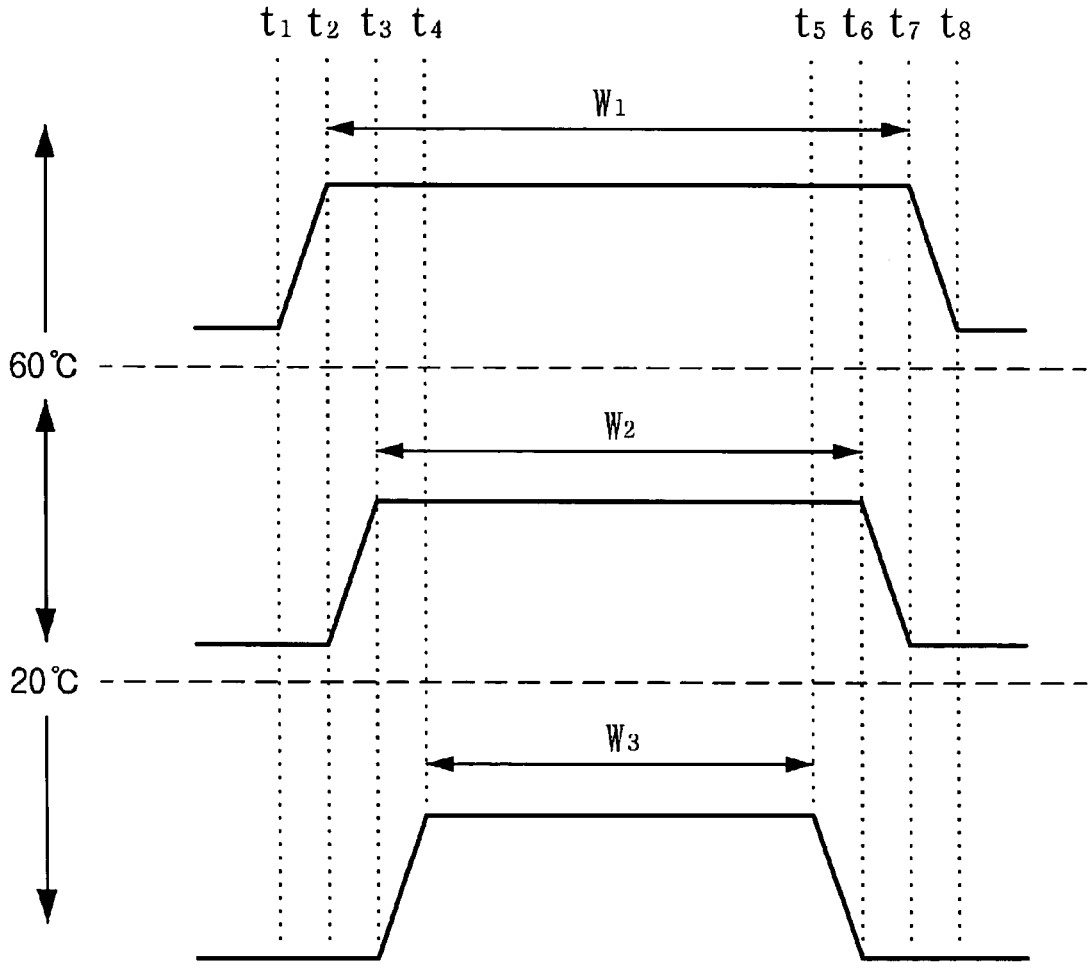
FIG. 6 illustrates an example of a method for setting a reference temperature in the method of driving the plasma display apparatus according to the embodiment of the present invention.

FIG. 6 illustrates an example of a method for setting a reference temperature in the method of driving the plasma display apparatus according to the embodiment of the present invention.

As shown in FIG. 6, the reference temperature of the plasma display apparatus is set to 20° C. and 60° C. When the temperature of the plasma display panel or the ambient temperature of the plasma display panel is equal to or less than 20° C., the sustain signal control unit 315 of FIG. 3 senses the temperature of the plasma display panel or the ambient temperature of the plasma display panel. Then, the sustain signal control unit 315 controls at least one of the scan driver 311 and the sustain driver 313 so that the duration of the maintenance period $W_3$ of the sustain signal is a value subtracting a time point $t_4$ from a time point $t_5$ ($t_5-t_4$).

Further, when the temperature of the plasma display panel or the ambient temperature of the plasma display panel is equal to or more than 60° C., the sustain signal control unit 315 senses the temperature of the plasma display panel or the ambient temperature of the plasma display panel. Then, the sustain signal control unit 315 controls at least one of the scan driver 311 and the sustain driver 313 so that the duration of the maintenance period $W_1$ of the sustain signal is a value subtracting a time point $t_2$ from a time point $t_7$ ($t_7-t_2$).

Figure 7:
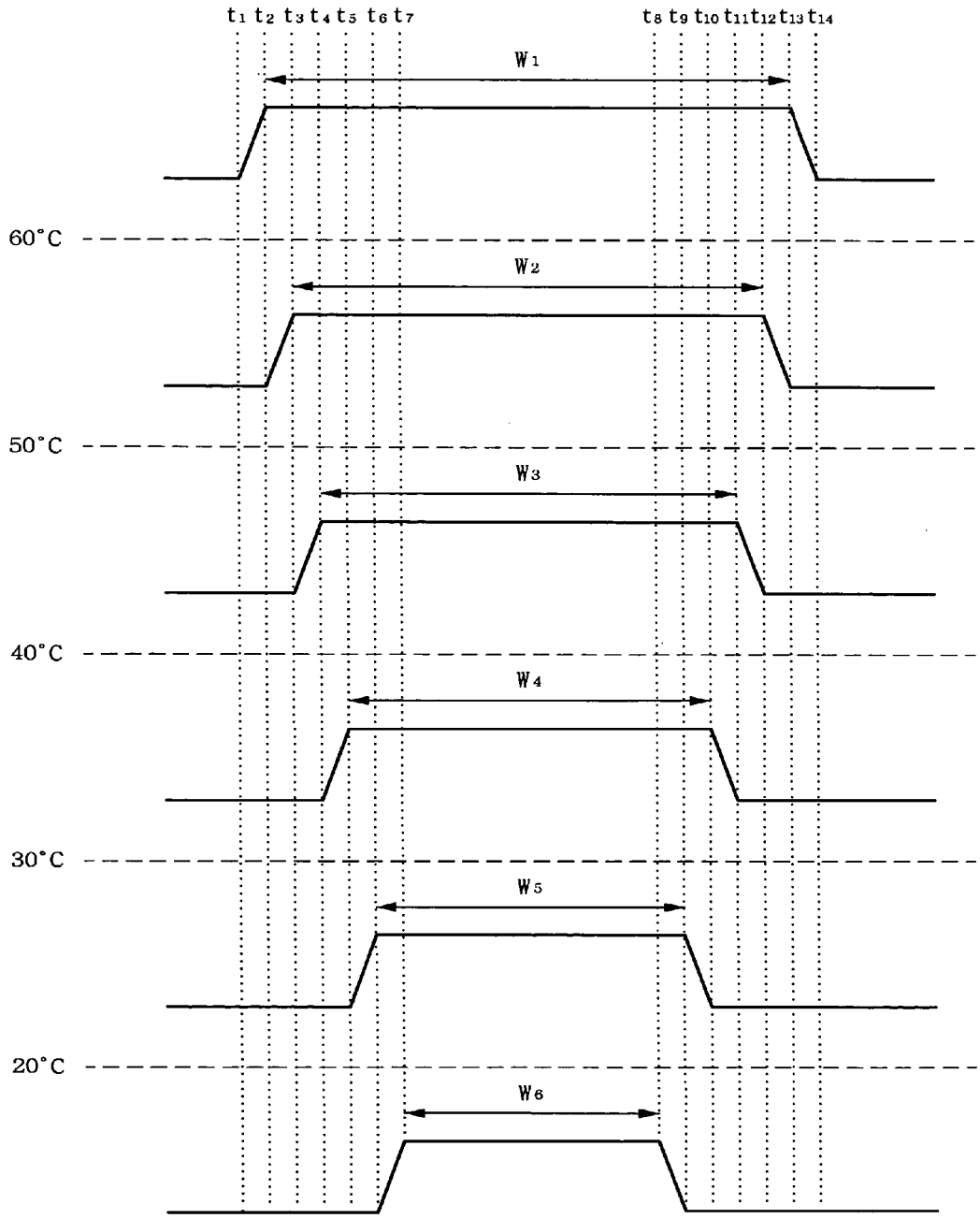
FIG. 7 illustrates another example of a method for setting a reference temperature in the method of driving the plasma display apparatus according to the embodiment of the present invention.

FIG. 7 illustrates another example of a method for setting a reference temperature in the method of driving the plasma display apparatus according to the embodiment of the present invention. As shown in FIG. 7, the number of reference temperatures equals to five (that is, 20° C., 30° C., 40° C., 50° C. and 60° C.).

As shown in FIG. 7, when the temperature of the plasma display panel or the ambient temperature of the plasma display panel is equal to or less than 20° C., the sustain signal control unit 315 senses the temperature of the plasma display panel or the ambient temperature of the plasma display panel. Then, the sustain signal control unit 315 controls at least one of the scan driver 311 and the sustain driver 313 so that the duration of a maintenance period $W_6$ of the sustain signal is a value subtracting a time point $t_7$ from a time point $t_8$ ($t_8-t_7$).

Further, when the temperature of the plasma display panel or the ambient temperature of the plasma display panel is above 20° C. and equal to or less than 30° C., the sustain signal control unit 315 senses the temperature of the plasma display panel or the ambient temperature of the plasma display panel. Then, the sustain signal control unit 315 controls at least one of the scan driver 311 and the sustain driver 313 so that the duration of a maintenance period $W_5$ of the sustain signal is a value subtracting a time point $t_6$ from a time point $t_9$ ($t_9-t_6$).

In the same way as the maintenance periods $W_6$ and $W_5$, when the temperature of the plasma display panel or the ambient temperature of the plasma display panel is above 30° C. and equal to or less than 40° C., the duration of a maintenance period $W_4$ of the sustain signal is a value subtracting a time point $t_5$ from a time point $t_{10}$ ($t_{10}-t_5$). When the temperature of the plasma display panel or the ambient temperature of the plasma display panel is above 40° C. and equal to or less than 50° C., the duration of a maintenance period $W_3$ of the sustain signal is a value subtracting a time point $t_4$ from a time point $t_{11}$ ($t_{11}-t_4$). When the temperature of the plasma display panel or the ambient temperature of the plasma display panel is above 50° C. and equal to or less than 60° C., the duration of a maintenance period $W_2$ of the sustain signal is a value subtracting a time point $t_3$ from a time point $t_{12}$ ($t_{12}-t_3$). When the temperature of the plasma display panel or the ambient temperature of the plasma display panel is above 60° C., the duration of a maintenance period $W_1$ of the sustain signal is a value subtracting a time point $t_2$ from a time point $t_{13}$ ($t_{13}-t_2$).

As shown in FIG. 7, when the number of reference temperatures equals to five, the number of temperature intervals equals to six. Further, when the number of reference temperatures equals to four, the number of temperature intervals equals to five.

In FIG. 6 or FIG. 7, the differences between the durations of the maintenance periods of the sustain signal may be equal to one another or may be different from one another.

Figure 8:
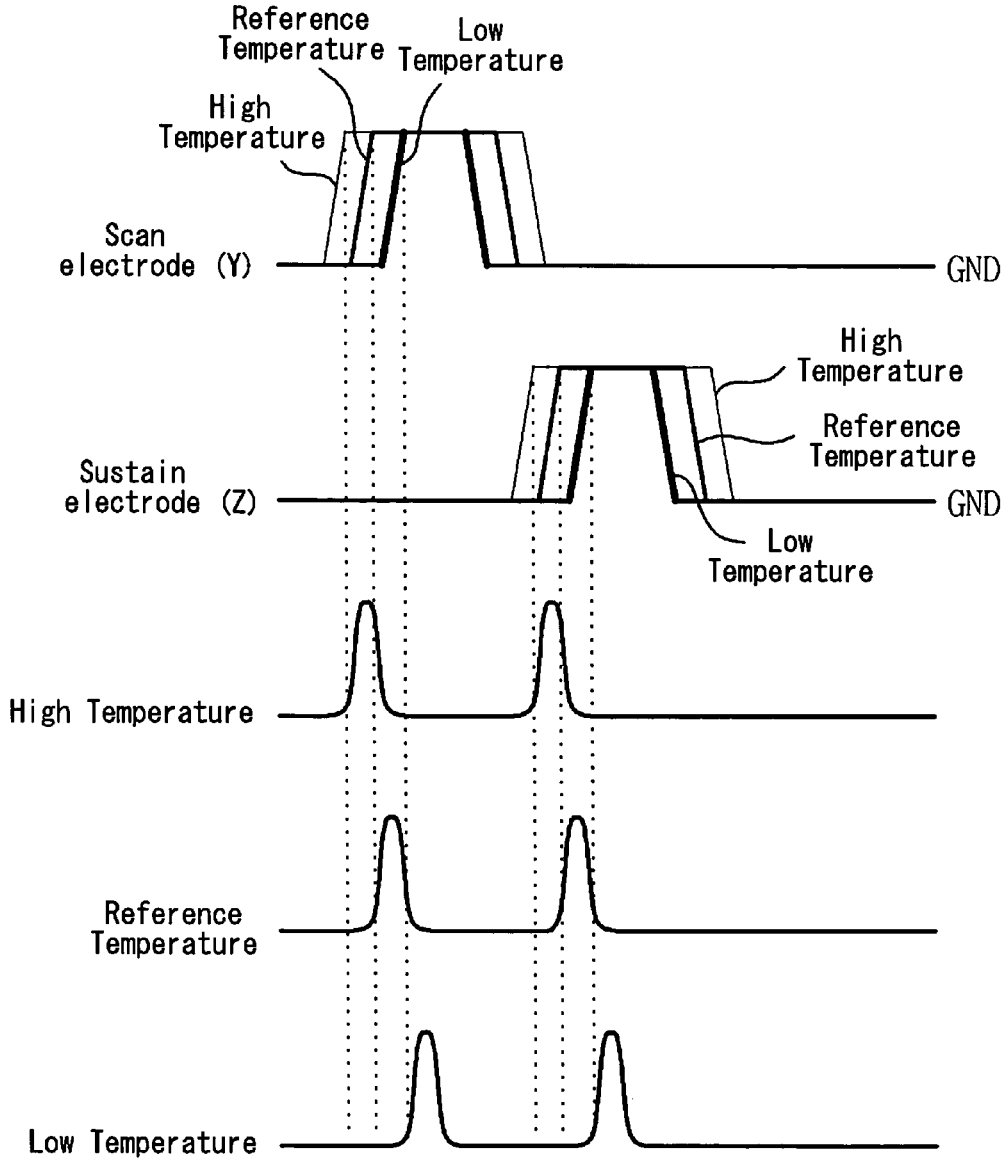
FIG. 8 illustrates a method of driving a plasma display apparatus according to another embodiment of the present invention.

FIG. 8 illustrates a method of driving a plasma display apparatus according to another embodiment of the present invention. As shown in FIG. 8, sustain signals are supplied to a scan electrode X and a sustain electrode Z in a sustain period, respectively. The sustain signal supplied to the scan electrode X and the sustain signal supplied to the sustain electrode Z overlap each other. It is preferable that the duration of time of a supply period of a pair of sustain signals, which overlap each other, is fixed irrespective of a temperature of a plasma display panel.

Since the duration of a maintenance period of the sustain signal changes depending on the temperature of the plasma display panel or the ambient temperature of the plasma display panel, the number of sustain signals in each of subfields may change. In the method of driving the plasma display apparatus according to another embodiment of the present invention, since the sustain signal supplied to the scan electrode Y and the sustain signal supplied to the sustain electrode Z overlap, no change in the number of sustain signals in each of the subfields occurs.

Figure 9:
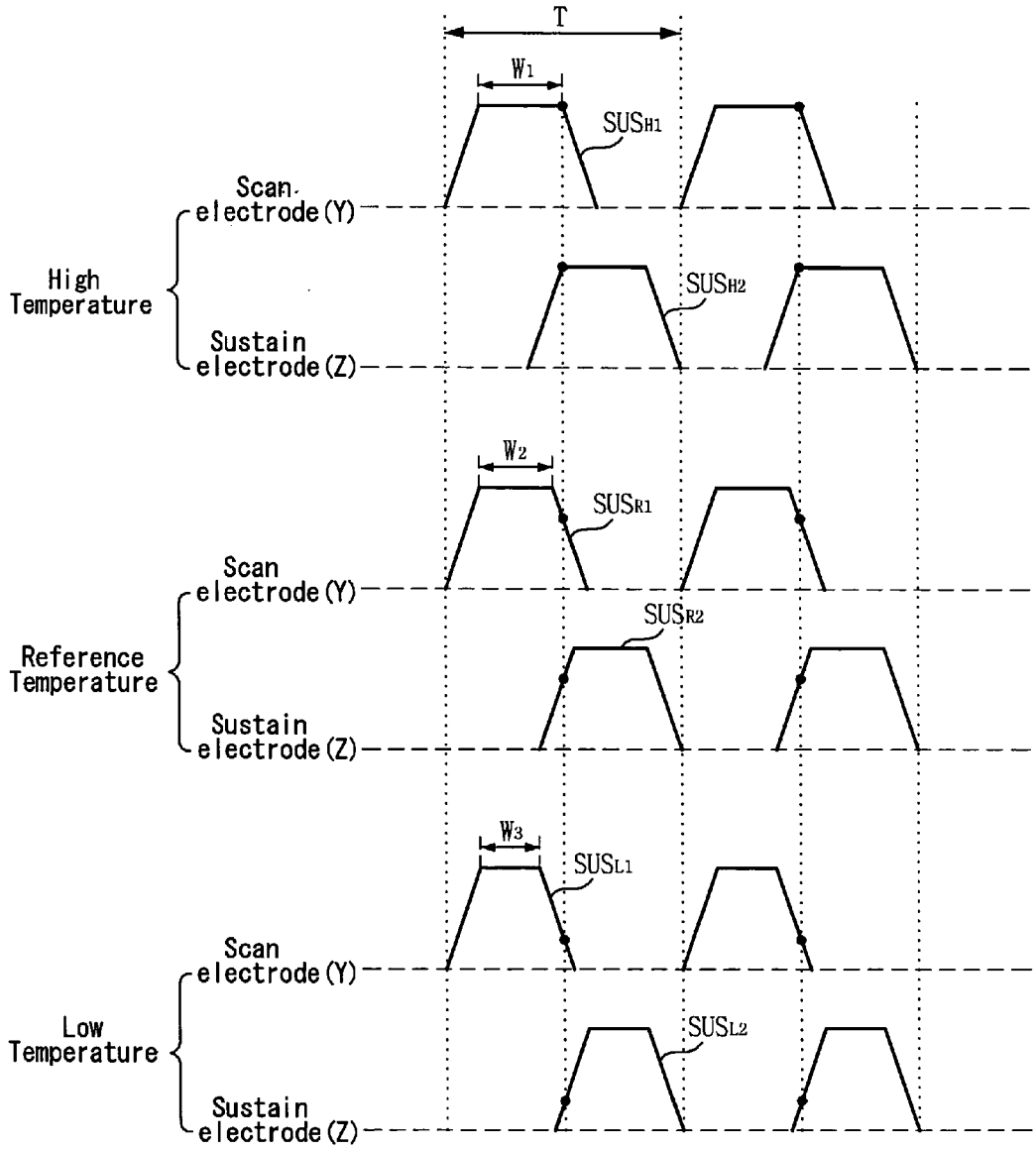
FIG. 9 illustrates an example of a supply period of a sustain signal in the method of driving the plasma display apparatus according to another embodiment of the present invention.

FIG. 9 illustrates an example of a supply period of a sustain signal in the method of driving the plasma display apparatus according to another embodiment of the present invention. As shown in FIG. 9, when the temperature of the plasma display panel or the ambient temperature of the plasma display panel is equal to the reference temperature, maintenance periods of sustain signals supplied to the scan electrode Y and the sustain electrode Z are represented by a reference symbol $W_2$. The sustain signal supplied to the scan electrode Y and the sustain signal supplied to the sustain electrode Z overlap each other. A supply period of a pair of sustain signals $SUS_{R1}$ and $SUS_{R2}$, which overlap each other, is represented by a reference symbol T.

When the temperature of the plasma display panel or the ambient temperature of the plasma display panel is higher than the reference temperature, maintenance periods of the sustain signals supplied to the scan electrode Y and the sustain electrode Z are represented by a reference symbol $W_1$. The sustain signal supplied to the scan electrode Y and the sustain signal supplied to the sustain electrode Z overlap each other. A supply period of a pair of sustain signals $SUS_{H1}$ and $SUS_{H2}$, which overlap each other, is represented by a reference symbol T.

When the temperature of the plasma display panel or the ambient temperature of the plasma display panel is lower than the reference temperature, maintenance periods of the sustain signals supplied to the scan electrode Y and the sustain electrode Z are represented by a reference symbol $W_3$. The sustain signal supplied to the scan electrode Y and the sustain signal supplied to the sustain electrode Z overlap each other. A supply period of a pair of sustain signals $SUS_{L1}$ and $SUS_{L2}$, which overlap each other, is represented by a reference symbol T.

As described above, in the method of driving the plasma display apparatus according to another embodiment of the present invention, when the sustain signal supplied to the scan electrode and the sustain signal supplied to the sustain electrode overlap each other, the duration of time of the supply period of the pair of sustain signal, which overlap each other, is fixed irrespective of the temperature of the plasma display panel or the ambient temperature of the plasma display panel.

The embodiment of the invention being thus described will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising an electrode; and a sustain signal supply unit configured to supply a first sustain signal to the electrode when an ambient temperature of the plasma display panel is equal to or higher than a reference temperature, and to supply a second sustain signal to the electrode when the ambient temperature of the plasma display panel is lower than the reference temperature, wherein the first sustain signal and the second sustain signal are different from each other, wherein the electrode is a scan electrode and the plasma display panel includes a sustain electrode, and wherein a time interval for a pair of sustain signals applied to the scan and sustain electrodes remains unchanged as the ambient temperature of the plasma display panel changes between a first temperature lower than the reference temperature and a second temperature higher than the reference temperature.

2. The plasma display apparatus of claim 1, wherein the application period of each of the first sustain signal and the second sustain signal comprises a rising period for rising from a first voltage to a second voltage, a maintenance period for maintaining the second voltage, and a falling period for falling from the second voltage to a third voltage, and wherein the duration of the maintenance period of the first sustain signal is different from the duration of the maintenance period of the second sustain signal.

3. The plasma display apparatus of claim 2, wherein the duration of the maintenance period of the first sustain signal is longer than the duration of the maintenance period of the second sustain signal.

4. The plasma display apparatus of claim 2, wherein the duration of the rising period of the first sustain signal is different from the duration of the rising period of the second sustain signal.

5. The plasma display apparatus of claim 4, wherein the duration of the rising period of the first sustain signal is shorter than the duration of the rising period of the second sustain signal.

6. The plasma display apparatus of claim 2, wherein the duration of the falling period of the first sustain signal is different from the duration of the falling period of the second sustain signal.

7. The plasma display apparatus of claim 6, wherein the duration of the falling period of the first sustain signal is shorter than the duration of the falling period of the second sustain signal.

8. The plasma display apparatus of claim 2, wherein the reference temperature is one of a plurality of reference temperatures, and wherein when the reference temperature is the lowest reference temperature in the plurality of reference temperatures, the duration of the maintenance period of the second sustain signal is shortest.

9. The plasma display apparatus of claim 2, wherein the duration of the maintenance period of the first sustain signal is one time to five times the rising period of the first sustain signal or the rising period of the second sustain signal longer than the duration of the maintenance period of the second sustain signal.

10. The plasma display apparatus of claim 1, wherein a time interval during which the pair of sustain signals overlap each other changes as the ambient temperature of the plasma display panel crosses the reference temperature.

11. A method of driving a plasma display apparatus comprising an electrode, the method comprising:

supplying a first sustain signal having a maintenance period to the electrode when an ambient temperature of the plasma display panel is equal to or higher than a reference temperature;

supplying a second sustain signal having a maintenance period to the electrode when the ambient temperature of the plasma display panel is lower than the reference temperature, wherein the duration of the maintenance period of the first sustain signal is different from the duration of the maintenance period of the second sustain signal, and wherein the first sustain signal and the second sustain signal are different from each other, the electrode is a scan electrode, and the plasma display panel includes a sustain electrode; and supplying a pair of sustain signals to the scan and sustain electrodes, wherein a time interval for a pair of sustain signals applied to the scan and sustain electrodes remains unchanged as the ambient temperature of the plasma display panel changes between a first temperature lower than the reference temperature and a second temperature higher than the reference temperature.

12. The method of claim 11, wherein the application period of each of the first sustain signal and the second sustain signal comprises a rising period for rising from a first voltage to a second voltage, the maintenance period for maintaining the second voltage, and a falling period for falling from the second voltage to a third voltage.

13. The method of claim 12, wherein the duration of the maintenance period of the first sustain signal is longer than the duration of the maintenance period of the second sustain signal.

14. The method of claim 11, wherein a time interval during which the pair of sustain signals overlap each other changes as the ambient temperature of the plasma display panel crosses the reference temperature.

15. A plasma display apparatus, comprising:

a plasma display panel comprising a scan electrode and a sustain electrode; and a driver configured to supply a sustain signal to the scan electrode and the sustain electrode during a sustain period of a subfield alternately, wherein the sustain signal supplied to the scan electrode partially overlaps with the sustain signal supplied to the sustain electrode, wherein the sustain signal supplied to the scan electrode and the sustain signal supplied to the sustain electrode overlap each other for a first time period when an ambient temperature of the plasma display panel is a first temperature, wherein the sustain signal supplied to the scan electrode and the sustain signal supplied to the sustain electrode overlap each other during a second time period when the ambient temperature of the plasma display panel is a second temperature higher than the first temperature, wherein the second time period is longer than the first time period, and wherein a time interval for a pair of sustain signals applied to the scan and sustain electrodes remains unchanged as the ambient temperature of the plasma display panel changes from the first temperature to the second temperature.

16. The apparatus of claim 15, wherein the sustain signal includes a rising period in which a voltage of the sustain signal rises from a ground level voltage to a sustain voltage, a maintenance period in which the voltage of the sustain signal is maintained at the sustain voltage, and a falling period in which the voltage of the sustain signal falls from the sustain voltage to the ground level voltage, and wherein the maintenance period of the sustain signal when the ambient temperature of the plasma display panel is the first temperature is longer than the maintenance period of the sustain signal when the ambient temperature of the plasma display panel is the second temperature.

17. A plasma display apparatus, comprising:

a plasma display panel comprising a scan electrode and a sustain electrode; and a driver configured to supply a sustain signal to the scan electrode and the sustain electrode during a sustain period of a subfield alternately;

wherein the sustain signal includes a rising period in which a voltage of the sustain signal rises from a ground level voltage to a sustain voltage, a maintenance period in which the voltage of the sustain signal is maintained at the sustain voltage, and a falling period in which the voltage of the sustain signal falls from the sustain voltage to the ground level voltage, wherein the maintenance period of the sustain signal when an ambient temperature of the plasma display panel is a first temperature is longer than the maintenance period of the sustain signal when the ambient temperature of the plasma display panel is a second temperature higher than the first temperature, and wherein a time interval for a pair of sustain signals applied to the scan and sustain remains unchanged as the ambient temperature of the plasma display panel changes from the first temperature to the second temperature.

18. A plasma display apparatus, comprising:

a plasma display panel comprising a scan electrode and a sustain electrode; and a driver configured to supply a sustain signal to the scan electrode and the sustain electrode during a sustain period of a subfield alternately, wherein the sustain signal includes a rising period in which a voltage of the sustain signal rises from a ground level voltage to a sustain voltage, a maintenance period in which the voltage of the sustain signal is maintained at the sustain voltage, and a falling period in which the voltage of the sustain signal falls from the sustain voltage to the ground level voltage, wherein a time interval for a pair of sustain signals applied to the scan electrode and the sustain electrode remains unchanged as an ambient temperature of the plasma display panel rises above or falls below a reference temperature, and wherein a sustain signal supplied to the scan electrode overlaps a sustain signal supplied to the sustain electrode only when the ambient temperature of the plasma display panel is higher than the first reference temperature.

* * * * *